US008733548B2

(12) United States Patent
Kuo et al.

(10) Patent No.: US 8,733,548 B2
(45) Date of Patent: May 27, 2014

(54) PACKAGING STRUCTURE OF LIQUID CRYSTAL GLASS PANEL

(71) Applicant: Shenzhen China Star Optoelectronics Technology Co., Ltd., Guandong (CN)

(72) Inventors: Yicheng Kuo, Shenzhen (CN); Shihhsiang Chen, Shenzhen (CN); Jiahe Cheng, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 22 days.

(21) Appl. No.: 13/702,107

(22) PCT Filed: Oct. 10, 2012

(86) PCT No.: PCT/CN2012/082660

§ 371 (c)(1),
(2), (4) Date: Dec. 5, 2012

(87) PCT Pub. No.: WO2014/047963

PCT Pub. Date: Apr. 3, 2014

(65) Prior Publication Data

US 2014/0083892 A1 Mar. 27, 2014

(51) Int. Cl.

| | |
|---|---|
| ***B65D 85/48*** | (2006.01) |
| ***B65D 81/05*** | (2006.01) |
| ***B65D 81/107*** | (2006.01) |

(52) U.S. Cl.

USPC ..... 206/454; 206/523; 206/586

(58) Field of Classification Search

USPC ..... 206/449, 454, 521, 523, 586–594

See application file for complete search history.

(56) References Cited

U.S. PATENT DOCUMENTS

| | | | | |
|---|---|---|---|---|
| 3,701,465 | A * | 10/1972 | Richter | 206/521 |
| 4,470,508 | A * | 9/1984 | Yen | 206/454 |
| 5,588,531 | A * | 12/1996 | Yoshida et al. | 206/454 |
| 5,904,251 | A * | 5/1999 | Ogata et al. | 206/454 |
| 7,059,473 | B2 * | 6/2006 | Watanabe et al. | 206/454 |
| 7,219,798 | B2 * | 5/2007 | Chen | 206/454 |
| 7,341,151 | B2 * | 3/2008 | Takagi | 206/454 |
| 2008/0128310 | A1 * | 6/2008 | Kao et al. | 206/521 |
| 2013/0306514 | A1 * | 11/2013 | Hu et al. | 206/586 |

FOREIGN PATENT DOCUMENTS

| | | | |
|---|---|---|---|
| CN | 1605549A | A | 4/2005 |
| CN | 2711086Y | Y | 7/2005 |

* cited by examiner

*Primary Examiner* — Bryon Gehman
(74) *Attorney, Agent, or Firm* — Andrew C. Cheng

(57) ABSTRACT

The present invention provides a packaging structure of liquid crystal glass panel, which includes a package box and a plurality of cushioning members mounted in the package box. The cushioning members each include a main body and an anti-static layer formed on a surface of the main body that opposes liquid crystal glass panels. The packaging structure of liquid crystal glass panel according to the present invention uses a cushioning member formed by an arrangement of combining a cushioning material and an anti-static material so as to provide an excellent effect of cushioning to liquid crystal glass panels during the shipping thereof and to effectively prevent the liquid crystal glass panels from damage caused by static electricity during the shipping thereof. Further, such a combined material has a low cost and can thus effectively lower down the shipping cost.

7 Claims, 7 Drawing Sheets

PACKAGING STRUCTURE OF LIQUID CRYSTAL GLASS PANEL

BACKGROUND OF THE INVENTION

1. Field of the Invention

The present invention relates to the field of packaging, and in particular to a packaging structure of liquid crystal glass panel.

2. The Related Arts

In the field of manufacture of liquid crystal display devices, the manufacture of liquid crystal display devices includes a process of assembling, which puts various components, including a liquid crystal glass panel, a main control circuit, and an enclosure, together. These components are each manufactured in advance and packaged for being later assembled to form a complete liquid crystal display device. The liquid crystal glass panel, after being manufactured, is packaged in a liquid crystal glass panel package box and then shipped in box to a corresponding assembling station. During the shipping of the liquid crystal glass panel, the liquid crystal glass panel is often damaged due to poor cushioning performance and poor ant-static performance of the package box. Currently, commonly used package boxes include paper boxes and plastic boxes. Plastic boxes have better structures and low costs, but they have poor cushioning property and poor anti-static property so that cushioning members must be additionally set up in the interior thereof to effect cushioning and to prevent the generation of static electricity.

A conventional liquid crystal glass panel package box has a structure illustrated in FIG. 1, comprising a lower case 100 and an upper case (not shown) that mate each other. A plurality of cushioning blocks 500 is provided inside the lower case 100 corresponding to edges of a liquid crystal glass panel 300. The lower case 100 comprises a mounting section 102 and the cushioning members 500 have one side that is fixed to the mounting section 102 by a double-sided adhesive tape. The lower case 100 also forms a recess 104 corresponding to a lower end of the cushioning member 500 so that the lower end of the cushioning member 500 is mounted in the recess 104 to complete the installation and fixation of the cushioning member 500 in the package of the liquid crystal glass panel 300.

To prevent the liquid crystal glass panel from being damaged by static electricity generated by the liquid crystal glass panel during the shipping thereof, cushioning members that are made of silica gel are used for anti-static purposes, so as to both effect cushioning and prevent the generation of static electricity.

However, the silica gel made cushioning members used in such a package structure is of high cost and is not easy to fix in position, whereby it is often that a liquid crystal glass panel gets broken due to detachment of the cushioning members during shipping or warehousing.

Thus, it is a challenge to the present inventor and those devoted themselves to the art to provide a cushioning member for use in packaging of liquid crystal glass panel that provides improved anti-static performance and has a low cost, realizes preventing the generation of static electricity and effecting excellent cushioning during the shipping of the liquid crystal glass panel, and also overcomes the problems of high cost and being not easy to fix of the cushioning members made of silica gel adopted in the conventional liquid crystal glass panel package.

SUMMARY OF THE INVENTION

An object of the present invention is to provide a liquid crystal glass panel packaging structure, which comprises a cushioning member that is formed by an arrangement of combining a cushioning material and an anti-static material so that the combined arrangement of cushioning member has excellent cushioning property, excellent anti-static property, and low cost and can thus effectively lower down shipping cost.

To achieve the object, the present invention provides a packaging structure of liquid crystal glass panel, which comprises a package box and a plurality of cushioning members mounted in the package box. The cushioning members each comprise a main body and an anti-static layer formed on a surface of the main body that opposes a liquid crystal glass panel.

The package box comprises a lower case and an upper case mating the lower case. The lower case forms mounting sections corresponding respectively to the cushioning members. The cushioning members are respectively mounted to the mounting section.

The main body comprises a cushioning section and a retention section connected to the cushioning section. The anti-static layer is formed on a surface of the cushioning section that opposes the liquid crystal glass panel.

The retention section comprises a pawl extending from an end of the cushioning section in a direction away from the surface of the cushioning section on which the anti-static layer is formed.

The mounting section is in the form of arch bridge. The retention section is engageable with a side of bridge floor with the cushioning section being positioned against the bridge floor so as to mount the cushioning member to the mounting section.

The cushioning section of the cushioning member forms, on a surface thereof opposing the bridge floor, a plurality of the projections. The bridge floor forms mounting holes corresponding to the projections. The projections are receivable in the mounting holes to fix the cushioning member in position.

The main body is in the form of a plate, which is attached to the mounting section by a double-sided adhesive tape.

The anti-static layer comprises a layer of silica gel.

The anti-static layer is combined with the main body through composite molding with a mold or hot pressing.

The main body is made of expandable polyethylene or ethylene-vinyl acetate copolymer.

The present invention also provides a packaging structure of liquid crystal glass panel, which comprises a package box and a plurality of cushioning members mounted in the package box, the cushioning members each comprising a main body and an anti-static layer formed on a surface of the main body that opposes a liquid crystal glass panel;

wherein the package box comprises a lower case and an upper case mating the lower case, the lower case forming mounting sections corresponding respectively to the cushioning members, the cushioning members being respectively mounted to the mounting section;

wherein the main body comprises a cushioning section and a retention section connected to the cushioning section, the anti-static layer being formed on a surface of the cushioning section that opposes the liquid crystal glass panel;

wherein the retention section comprises a pawl extending from an end of the cushioning section in a direction away from the surface of the cushioning section on which the anti-static layer is formed;

wherein the mounting section is in the form of arch bridge, the retention section being engageable with a side of bridge floor with the cushioning section being positioned against the bridge floor so as to mount the cushioning member to the mounting section;

wherein the cushioning section of the cushioning member forms, on a surface thereof opposing the bridge floor, a plurality of the projections, the bridge floor forming mounting holes corresponding to the projections, the projections being receivable in the mounting holes to fix the cushioning member in position;

wherein the anti-static layer comprises a layer of silica gel;

wherein the anti-static layer is combined with the main body through composite molding with a mold or hot pressing; and wherein the main body is made of expandable polyethylene or ethylene-vinyl acetate copolymer.

The efficacy of the present invention is that the present invention provides a packaging structure of liquid crystal glass panel, which comprises a cushioning member formed by an arrangement of combining a cushioning material and an anti-static material so as to provide an excellent effect of cushioning to liquid crystal glass panels during the shipping thereof and to effectively prevent the liquid crystal glass panels from damage caused by static electricity during the shipping thereof. Further, such a combined material has a low cost and can thus effectively lower down the shipping cost.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

Figure 1:
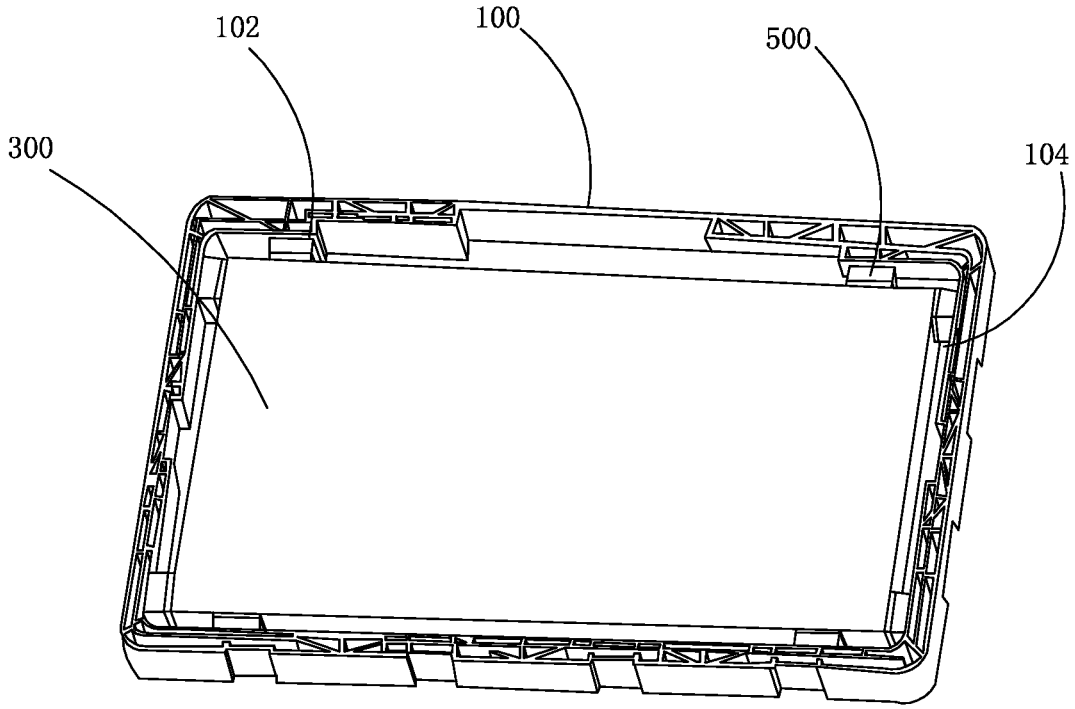
FIG. 1 is a schematic view illustrating a conventional packaging structure of liquid crystal glass panel.
Figure 2:
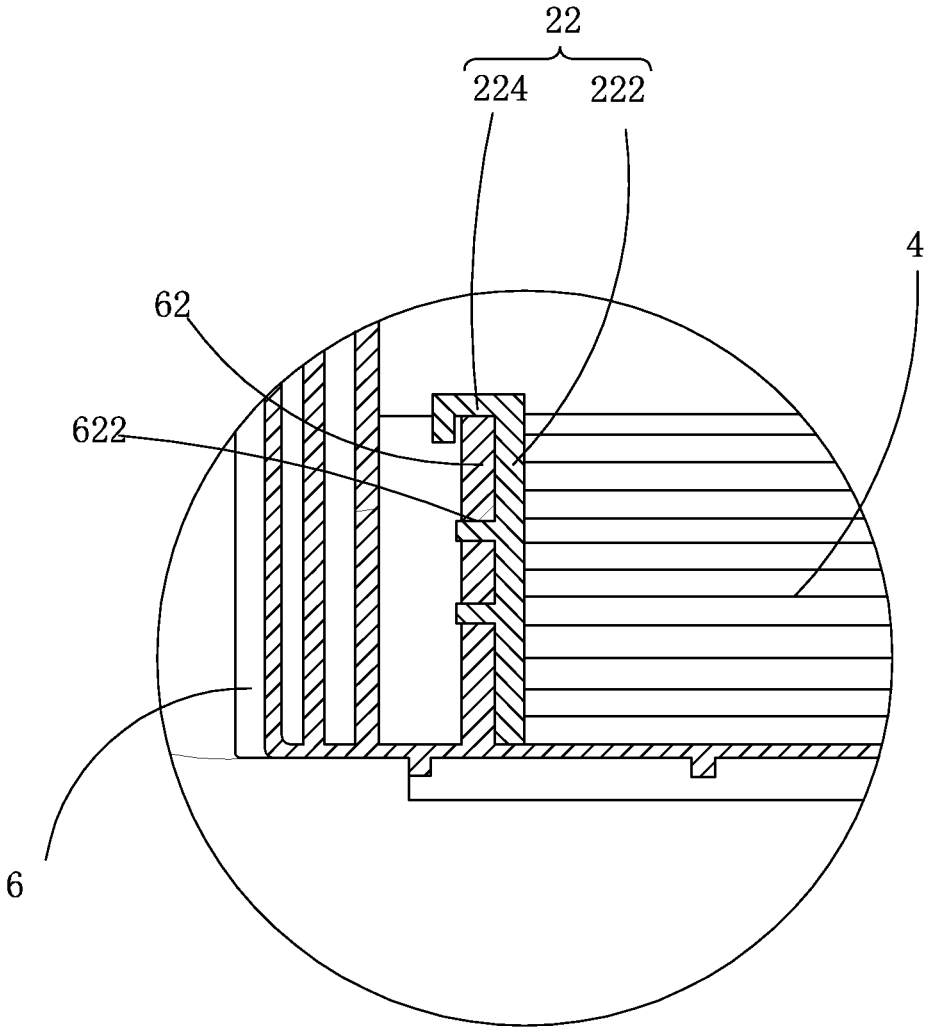
FIG. 2 is a partial cross-sectional view of a packaging structure of liquid crystal glass panel according to the present invention.
Figure 3:
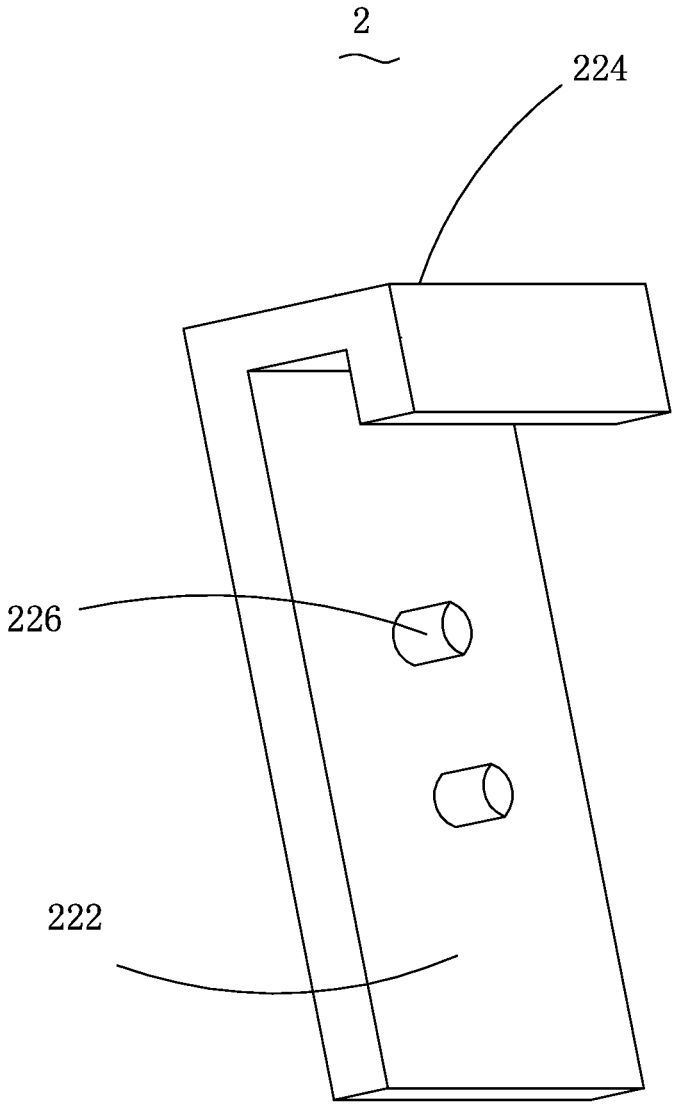
FIG. 3 is a front side perspective view of a cushioning body of FIG. 2.
Figure 4:
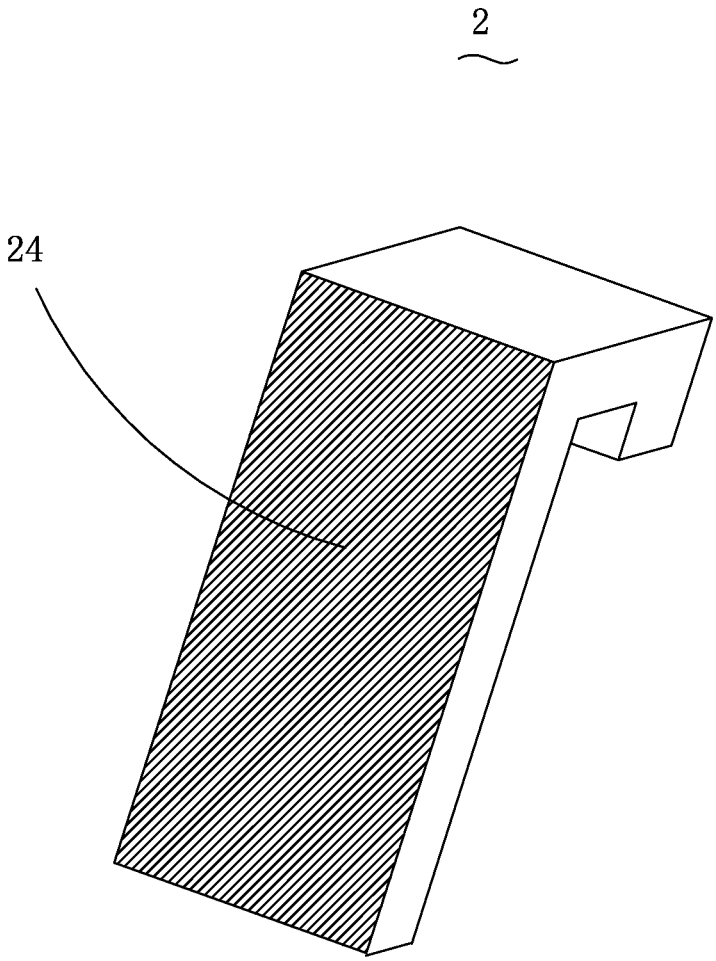
FIG. 4 is a back side perspective view of the cushioning body of FIG. 3.
Figure 5:
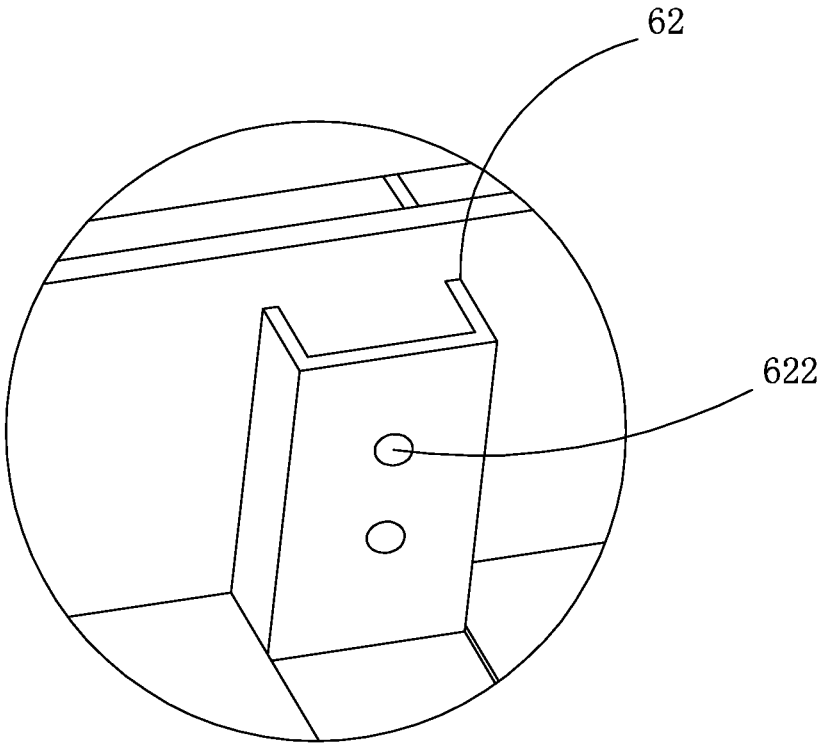
FIG. 5 is a perspective view of a mounting section of FIG. 3.

To further expound the technical solution adopted in the present invention and the advantages thereof, a detailed description is given to a preferred embodiment of the present invention and the attached drawings.

Referring to FIGS. 2-5, the present invention provides a packaging structure of liquid crystal glass panel, which comprises a package box (not shown) and a plurality of the cushioning members 2 mounted inside the package box. The cushioning members 2 each comprises a main body 22 and an anti-static layer 24 formed on a surface of the main body that opposes liquid crystal glass panels 4. The anti-static layer 24 comprises a layer of silica gel. Silica gel has excellent property of electrical insulation and elasticity. It only needs a thin layer of silica gel provided on the cushioning member 2 so that the cost can be reduced. It can effectively prevent the generation of static electricity and may undergo elastic deformation when acted upon by an external force to cushion such an external force and may quickly resume the original shape after the external force is removed so that bettered protection can be applied to the liquid crystal glass panels 4.

The package box comprises a lower case 6 and an upper case (not shown) mating the lower case 6. The upper case and the lower case 6 are made of plastics. Cases made of plastics are of better structures than ordinary cartons or paper boxes and are repeatedly usable without cracking and are resistant to humidity and water so that better protection can be provided. Further, repeated use of the package box allows of reduction of packaging cost.

The lower case 6 forms mounting sections 62 corresponding respectively to the cushioning members 2 and the cushioning members 2 are respectively mounted to the mounting section 62.

The main body 22 comprises a cushioning section 222 and a retention section 224 connected to the cushioning section 222. The anti-static layer 24 is formed on a surface of the cushioning section 222 that opposes the liquid crystal glass panels 4. The main body 22 can be made of expandable polyethylene (EPE) or ethylene-vinyl acetate copolymer (EVA), these materials being of excellent cushioning capability and cheap in cost so as to effectively lower down the cost.

The anti-static layer 24 is combined with the main body 22 through composite molding with a mold or hot pressing. Such a way of combination effectively combines the anti-static layer 24 and the main body 22 together.

The retention section 224 comprises a pawl extending from an end of the cushioning section 222 in a direction away from the surface of the cushioning section 222 on which the anti-static layer 24 is formed.

The mounting section 62 is set in the form of arch bridge. The retention section 224 is engageable with a side of the bridge floor with the cushioning section 222 positioned against the bridge floor so as to mount the cushioning member 2 to the mounting section 62.

The cushioning section 222 of the cushioning member 2 forms, on a surface thereof opposing the bridge floor, a plurality of projections 226. The bridge floor forms mounting holes 622 corresponding to the projections 226. The projections 226 are received in the mounting holes 622 to further fix the cushioning member 2 in position. To set up, the retention section 224 is first put into engagement with the side of the bridge floor and then the cushioning section 222 and the projections 226 formed on the cushioning section 222 are positioned on the floor surface and into the mounting holes 622 of the bridge floor that correspond to the projections 226 to thereby complete the fixation between the cushioning member 2 and the mounting section 62. The retention section 224 that is set in engagement with the bridge floor can prevent the cushioning member 2 from displacing when acted upon by a horizontal force during a process of shipping. The engagement between the projections 226 of the cushioning section 222 and the mounting holes 622 can effectively prevent the cushioning member 2 from displacing when acted upon by a vertical force during the process of shipping thereby well mounting the cushioning member 2 to the mounting section 62 to effectively protect the liquid crystal glass panels 4.

Figure 6:
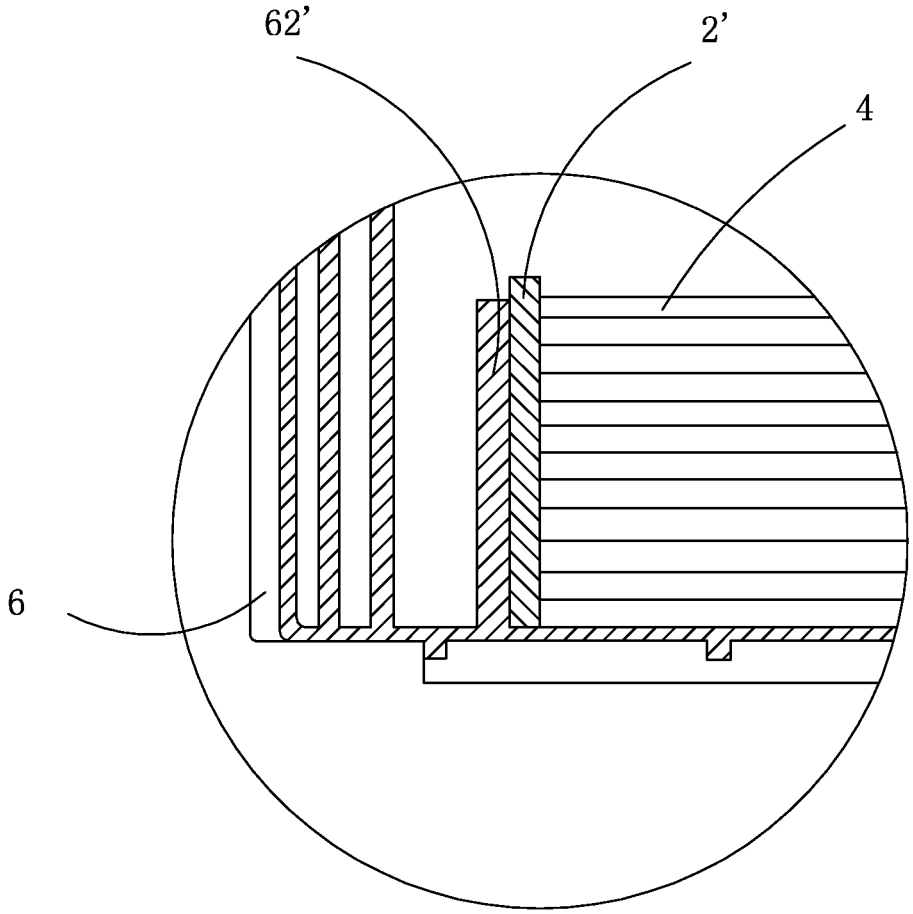
FIG. 6 is a partial cross-sectional view of another packaging structure of liquid crystal glass panel according to the present invention.
Figure 7:
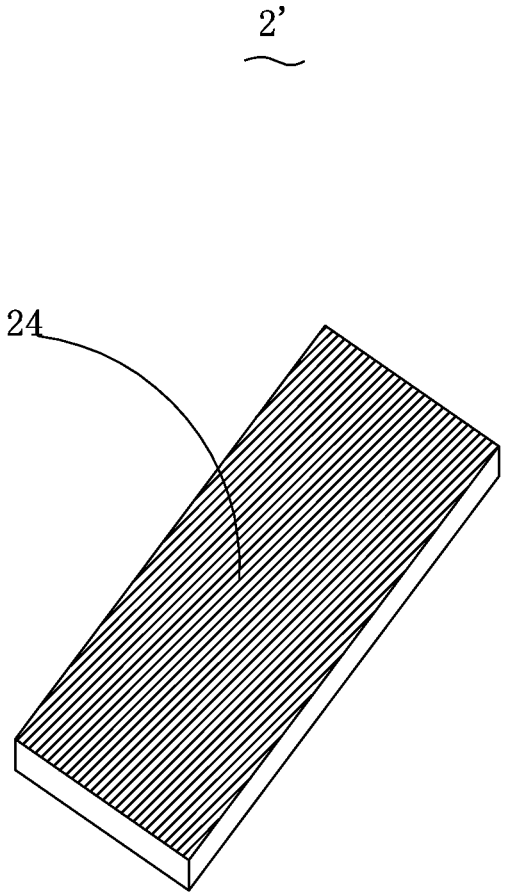
FIG. 7 is a perspective view of a cushioning body of FIG. 6.

Referring to FIGS. 6 and 7, schematic views of a packaging structure of liquid crystal glass panel according to another preferred embodiment of the present invention are shown. In the instant embodiment, the main body 22' is in the form of a plate, which is attached to the mounting section 62' by a double-sided adhesive tape (not shown). Such a way of bonding can be realized with a double-sided adhesive tape or PP plastic bonding agent, PE plastic bonding agent, PS plastic bonding agent, and PVC plastic bonding agent. The double-sided adhesive tape is preferable in the instant embodiment. Using a double-sided adhesive tape to mount and fix the main body 22' to the mounting section 622' may well fix the main body 22' in position. Further, a double-sided adhesive tape can be trimmed to any desired shape, is easy to remove, and is easy to clean off the residual adhesive after removal. In addition, double-sided adhesive tapes are cheap is cost and are of efficacy of environmental protection.

The instant embodiment shows the same technical effectiveness as the previous embodiment.

In summary, the present invention provides a packaging structure of liquid crystal glass panel, which comprises a cushioning member formed by an arrangement of combining a cushioning material and an anti-static material so as to provide an excellent effect of cushioning to liquid crystal glass panels during the shipping thereof and to effectively prevent the liquid crystal glass panels from damage caused by static electricity during the shipping thereof. Further, such a combined material has a low cost and can thus effectively lower down the shipping cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A packaging structure of a liquid crystal glass panel, comprising a package box and a plurality of cushioning members mounted in the package box, each of the plurality of cushioning members comprising a main body and an anti-static layer formed on a surface of the main body that opposes a liquid crystal glass panel;

wherein the package box comprises a lower case and an upper case mating with the lower case, the lower case forming mounting sections corresponding respectively to the cushioning members, the cushioning members being respectively mounted to the mounting section;

wherein the main body comprises a cushioning section and a retention section connected to the cushioning section, the anti-static layer being formed on a surface of the cushioning section that opposes the liquid crystal glass panel;

wherein the retention section comprises a pawl extending from an end of the cushioning section in a direction away from the surface of the cushioning section on which the anti-static layer is formed; and wherein the mounting section is in the form of an arch bridge, the retention section being engageable with a side of a bridge floor of the arch bridge with the cushioning section being positioned against the bridge floor so as to mount the cushioning member to the mounting section.

2. The packaging structure of the liquid crystal glass panel as claimed in claim 1, wherein the cushioning section of the cushioning member forms, on a surface thereof opposing the bridge floor, a plurality of projections, the bridge floor forming mounting holes corresponding to the projections, the projections being receivable in the mounting holes to fix the cushioning member in position.

3. The packaging structure of the liquid crystal glass panel as claimed in claim 1, wherein the main body is in the form of a plate, which is attached to the mounting section by a double-sided adhesive tape.

4. The packaging structure of the liquid crystal glass panel as claimed in claim 1, wherein the anti-static layer comprises a layer of silica gel.

5. The packaging structure of the liquid crystal glass panel as claimed in claim 4, wherein the anti-static layer is combined with the main body through composite molding with a mold or hot pressing.

6. The packaging structure of the liquid crystal glass panel as claimed in claim 1, wherein the main body is made of expandable polyethylene or ethylene-vinyl acetate copolymer.

7. A packaging structure of a liquid crystal glass panel, comprising a package box and a plurality of cushioning members mounted in the package box, each of the plurality of cushioning members comprising a main body and an anti-static layer formed on a surface of the main body that opposes a liquid crystal glass panel;

wherein the package box comprises a lower case and an upper case mating with the lower case, the lower case forming mounting sections corresponding respectively to the cushioning members, the cushioning members being respectively mounted to the mounting section;

wherein the main body comprises a cushioning section and a retention section connected to the cushioning section, the anti-static layer being formed on a surface of the cushioning section that opposes the liquid crystal glass panel;

wherein the retention section comprises a pawl extending from an end of the cushioning section in a direction away from the surface of the cushioning section on which the anti-static layer is formed;

wherein the mounting section is in the form of an arch bridge, the retention section being engageable with a side of a bridge floor of the arch bridge with the cushioning section being positioned against the bridge floor so as to mount the cushioning member to the mounting section;

wherein the cushioning section of the cushioning member forms, on a surface thereof opposing the bridge floor, a plurality of projections, the bridge floor forming mounting holes corresponding to the projections, the projections being receivable in the mounting holes to fix the cushioning member in position;

wherein the anti-static layer comprises a layer of silica gel;

wherein the anti-static layer is combined with the main body through composite molding with a mold or hot pressing; and wherein the main body is made of expandable polyethylene or ethylene-vinyl acetate copolymer.

* * * * *